US008281980B2

(12) United States Patent
Räsänen et al.

(10) Patent No.: US 8,281,980 B2
(45) Date of Patent: Oct. 9, 2012

(54) CUP PACKAGE MADE OF A FIBRE-BASED MATERIAL

(75) Inventors: Jari Räsänen, Imatra (FI); Seppo Karine, Imatra (FI)

(73) Assignee: Stora Enso Oyj, Helsinki (FI)

( * ) Notice: Subject to any disclaimer, the term of this patent is extended or adjusted under 35 U.S.C. 154(b) by 1416 days.

(21) Appl. No.: 10/591,170

(22) PCT Filed: Mar. 21, 2005

(86) PCT No.: PCT/FI2005/000162

§ 371 (c)(1),
(2), (4) Date: Aug. 30, 2006

(87) PCT Pub. No.: WO2005/090194

PCT Pub. Date: Sep. 29, 2005

(65) Prior Publication Data

US 2007/0181659 A1 Aug. 9, 2007

(30) Foreign Application Priority Data

Mar. 22, 2004 (FI) ..... 20040431

(51) Int. Cl.
*B65D 3/10* (2006.01)
*B65D 3/26* (2006.01)

(52) U.S. Cl. ..... 229/123.2; 229/125.35; 229/404

(58) Field of Classification Search ..... 229/123.2, 229/125.35, 404, 125.17, 125.25; 220/359.1, 220/359.3, 359.4

See application file for complete search history.

(56) References Cited

U.S. PATENT DOCUMENTS

| | | | | |
|---|---|---|---|---|
| 1,463,437 | A * | 7/1923 | Oliver | 229/5.5 |
| 2,940,654 | A * | 6/1960 | Easter | 229/125.35 |
| 2,941,660 | A * | 6/1960 | Tupper | 229/123.2 |
| 2,998,158 | A * | 8/1961 | Tupper | 220/276 |
| 3,095,132 | A * | 6/1963 | Hawley | 229/404 |
| 3,104,045 | A * | 9/1963 | Sheninger et al. | 229/404 |

(Continued)

FOREIGN PATENT DOCUMENTS

FI 97358 A 3/1991

(Continued)

OTHER PUBLICATIONS

English translation of Japanese Office Action mailed on Dec. 24, 2010 in corresponding Japanese Patent Application No. 2007-504431.

*Primary Examiner* — Gary Elkins
(74) *Attorney, Agent, or Firm* — Birch, Stewart, Kolasch & Birch, LLP

(57) ABSTRACT

The invention relates to a cup package made of a fiber-based material, such as polymer-coated packaging board, comprising a cup (1) containing a packaged product (2) and a lid (6) closing the mouth of the cup. In accordance with the invention, the cup (1) has a collar (5) bent downwardly from the mouth of the cup and diverging from the cup skirt (3), and the lid (6) has a rim (8) oriented accordingly downwardly from the collar, the lid being fixed in position by heat-sealing between said collar and rim parts. For opening the package, the lid (6) can be equipped with a tear strip (11) surrounding its rim (8). In addition, the lid (6) may be nested with the cup (1), so that compression and friction between their opposite surfaces retain the lid in position in the reclosed package.

12 Claims, 3 Drawing Sheets

U.S. PATENT DOCUMENTS

Figure 1:
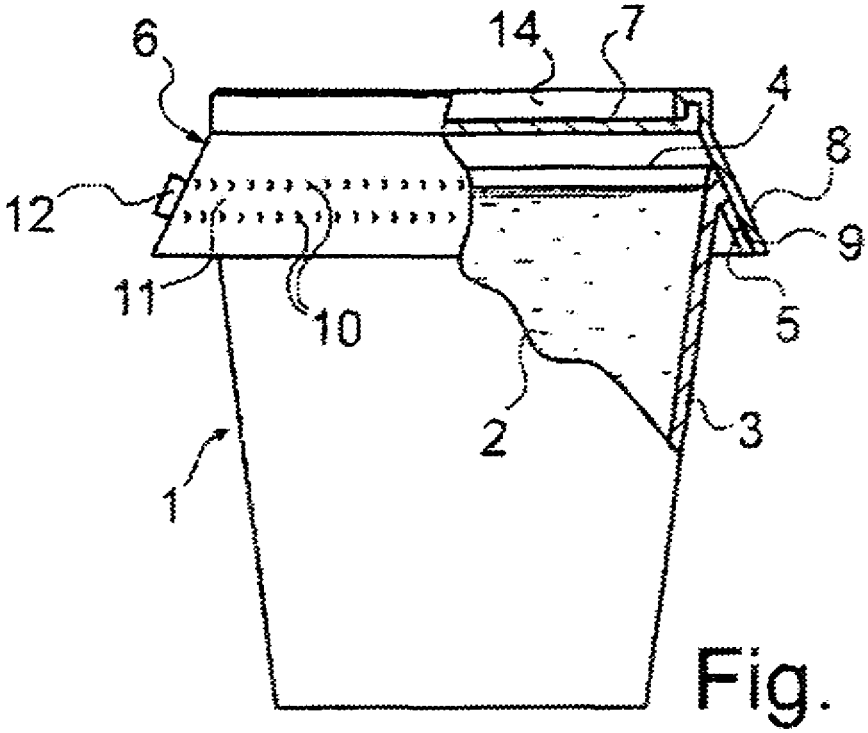

| | | | | | |
|---|---|---|---|---|---|
| 3,515,334 | A | * | 6/1970 | Jacobson | 229/125.35 |
| 3,557,998 | A | * | 1/1971 | Collie | 229/123.2 |
| 3,625,785 | A | * | 12/1971 | Holmstrom et al. | 229/125.35 |
| 4,044,941 | A | * | 8/1977 | Knudsen | 220/359.4 |
| 4,171,084 | A | * | 10/1979 | Smith | 229/5.5 |
| 4,209,126 | A | * | 6/1980 | Elias | 229/123.2 |
| 4,261,502 | A | * | 4/1981 | Ohmori | 229/404 |
| 4,551,366 | A | * | 11/1985 | Maruhashi et al. | 229/400 |
| 5,236,120 | A | | 8/1993 | Kleemola et al. | |
| 2006/0191940 | A1 | * | 8/2006 | Heyn | 229/125.35 |

FOREIGN PATENT DOCUMENTS

| | | | |
|---|---|---|---|
| GB | 719404 | A | 12/1954 |
| GB | 1 126 292 | A | 9/1968 |
| GB | 2 236 099 | A | 3/1991 |
| JP | 33-10983 | U | 7/1956 |
| JP | 57-140384 | U | 9/1982 |
| JP | 4-189756 | A | 7/1992 |
| JP | 2003-63520 | A | 3/2003 |
| WO | WO-03/068613 | A1 | 8/2003 |

* cited by examiner

CUP PACKAGE MADE OF A FIBRE-BASED MATERIAL

The invention relates to a cup package made of a fibre-based material, comprising a cup containing a packaged product and a lid for closing the mouth of the cup.

Cups provided with a heat-sealed tear tab lid are commonly used especially as portion packages of liquid or humid foodstuffs. Milk, yoghurt, juices, water and desserts can be mentioned as typical products to be packaged. Such cups are conventionally made of plastic, such as polypropene or polystyrene, while the tear tab lids are made of aluminium, however, polymer-coated board, which is a more environment-friendly material, is increasingly used as the material of the cups and the lids.

The cups of the cup packages are usually conical, so that they can be piled before being filled and closed with a lid. The lid closing the cup mouth is horizontal and heat-sealed to a rim tab protruding laterally from the mouth of the cup. The lid can be equipped with a flap protruding from its side in order to facilitate removal of the lid.

In the prior art cup packages mentioned above, the rim tab of the cup, to which the lid is heat-sealed, provides but a narrow support surface for the heat-sealing tool. Accordingly, the heat seal around the mouth of the cup will become narrow. In a cup package filled up near the mouth of the cup, the heat-sealing tools will get in the vicinity of the packaged product, and this may harm heat-sensitive products.

The principal objective of the present invention is to modify a cup package made of a fibre-based material such as packaging board, allowing the lid to be reliably heat-sealed to the mouth of the cup without jeopardising the product to be packaged. The package of the invention that resolves this problem is characterised by the cup comprising a collar bent downwardly from its mouth and diverging from the skirt of the cup, and in that the lid has a downwardly oriented rim, at which the lid is attached to the collar by heat sealing.

In the package of the invention, the collar of the cup acts as a heat-sealing support for the lid designed to match the cup, this support being broader than the rim tabs of known cups. The heat seal surrounding the collar can be given a larger width and the lower surface of the collar provides a support surface for the counter-piece of the heat-sealing tool, thus allowing generation of a seam by pressing the collar and the rim of the lid against each other while increasing the distance of the heated part of the tool from the product present in the cup.

A board cup provided with a collar has been disclosed per se by WO 03/068613, which describes a disposable board cup with a collar intended for hot and cold drinks. However, such disposable cups marketed piled on each other do not comprise a lid, nor does the reference mention that the cup would be closed.

In the package of the invention, the cup skirt may be enlarged conically upwardly and the collar of the cup may be tapered conically downwardly. The skirt and the collar can be formed by creasing and bending a sheet-like blank having the basic shape of a part of a circular sector. The manufacture of such a cup, in which the skirt and the collar have the same coning angle, is disclosed by WO 03/068613 mentioned above, which is thus incorporated in the present description. The rim of the lid to be sealed in the cup is also given a conical shape so as to fit tightly against the collar of the cup.

The material used for the cup and the lid may consist of packaging board equipped with a polymer coating layer that is repellent or water vapour tight. The polymer coating may be provided either on one side or on both sides of the board.

The polymer coating layers on the upper surface of the collar and the lower surface of the lid rim may serve as heat-sealing means for the package. If the inner surfaces of the cup and the lid are equipped with a multi-layer coating comprising at least one inner oxygen barrier layer and a heat-sealing layer covering this, the package is made both water-vapour proof and oxygen proof.

In a preferred embodiment of the invention, the lid of the package is provided with a recess defined by a conical surface and nested with the cup, so that the friction and/or compression between the skirt of the cup and the opposite conical surfaces of the recess in the lid retain the lid in position in the closed package. This solution enables an open package to be reclosed, so that the contents of the package do not necessarily have to be consumed at once.

It is also possible to form a recess in the lid of the package with the purpose to receive the bottom of the package placed on top of this as the packages are piled. Such a recess saves space and increases the stability of the pile.

The package of the invention can be opened by means of an annular tear strip provided in the area of the rim of the lid. The tear strip may be an annular stripe, which is defined by two aligned lines of perforations and can be detached by pulling.

The tear strip may also be a stripe between a row of perforations and the rim of the lid, and then it will be necessary that the heat seal is located within the area of the tear strip and is a peelable seal, which is released as the strip is removed. When the tear strip is located inside the sealing line, a peelable heat seal is not required.

The perforations in the line of perforations defining the tear strip can be formed such that they penetrate through the board layer of the lid but leave the subjacent polymer coating intact. In this manner, the perforations do not break the water vapour and/or oxygen barrier achieved with the polymer coating and the heat seal in the package. When the package is opened, the stripe forming the tear strip will anyhow be removed together with the polymer coating, in other words, the coating ruptures along the edges of the strip without hampering the detachment of the strip and the adjacent lid from the collar of the cup.

Figure 2:
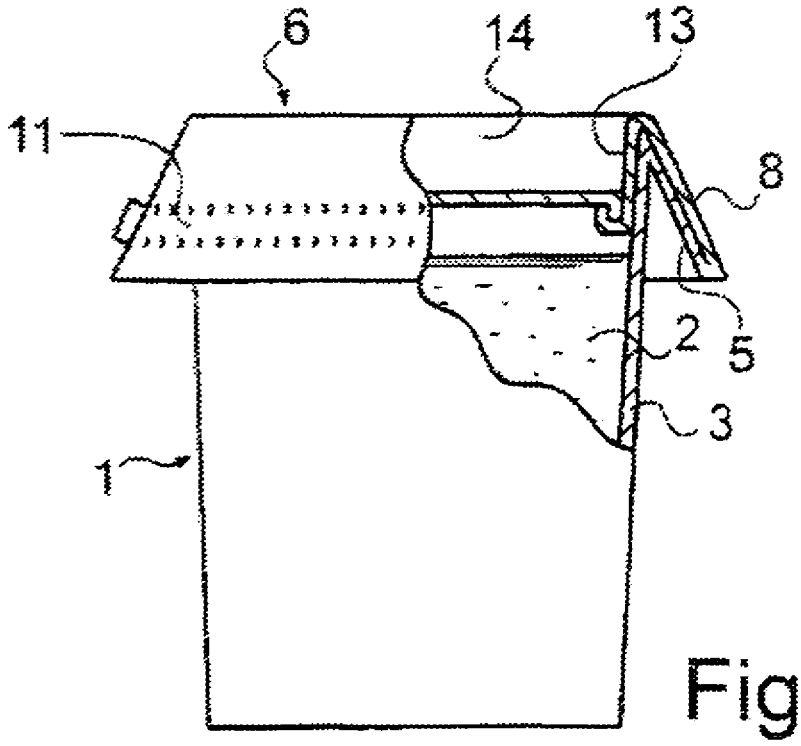
Figure 3:
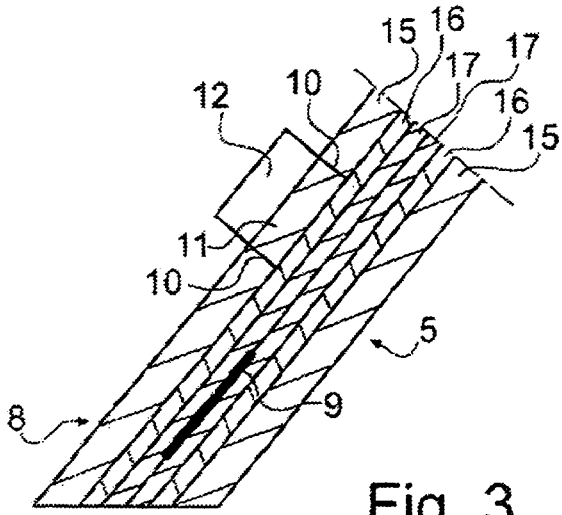
Figure 4:
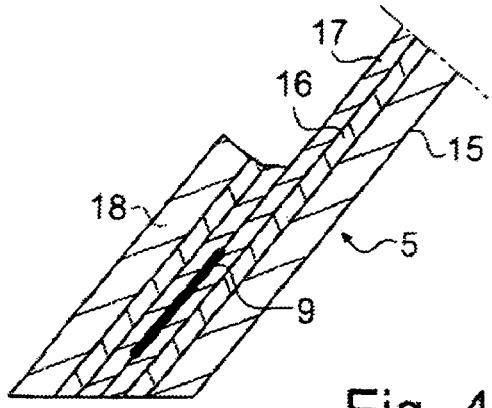
Figure 5:
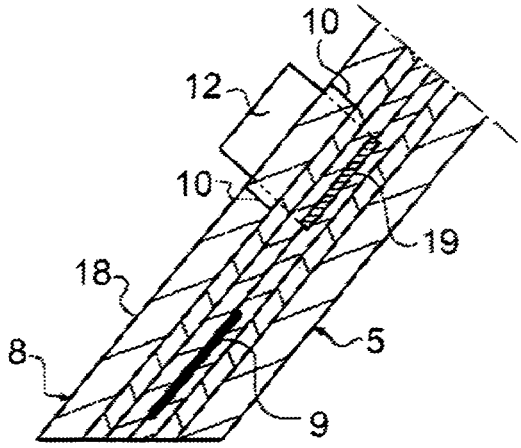
Figure 6:
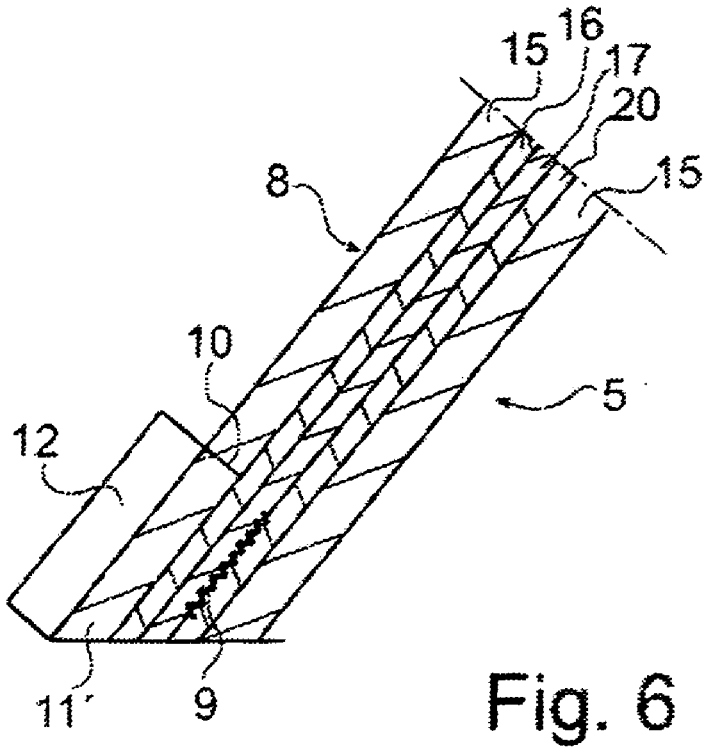
Figure 7:
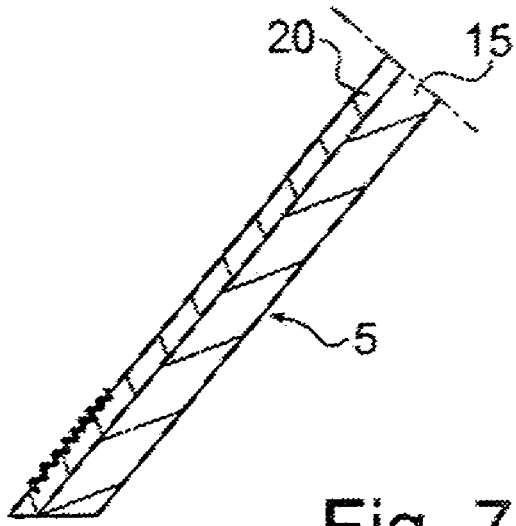

The invention will be explained in further detail below, with reference to the accompanying drawings, in which FIG. 1 shows a lidded cup package of the invention in partial section, FIG. 2 shows another lidded cup package of the invention in partial section, FIG. 3 is a section of the heat seal between the cup skirt and the lid rim and of the tear strip in the packages of FIGS. 1 and 2, FIG. 4 shows the seal point corresponding to FIG. 3 after the package has been opened, FIG. 5 shows an optional embodiment of the tear strip corresponding to FIG. 3, FIG. 6 shows an embodiment in which the tear strip is located at the heat seal, corresponding to FIG. 3, and FIG. 7 shows the seal point after the package has been opened, corresponding to FIG. 6.

The cup package of FIG. 1 is a lidded food portion package manufactured from polymer-coated packaging board. The food may be e.g. a drink, a dessert or a snack, which is intended for intake at once with this type of package.

The package of FIG. 1 comprises a cup 1 containing the packaged product 2 and whose skirt 3 has a conically upwardly enlarged shape. The skirt 3 is bent at the mouth 4 of the cup to form a conically downwardly enlarged collar 5. The cup 1 can be manufactured with the technique described in WO 03/068613, the coning angle of the cup skirt 3 and the collar 5 being identical.

The cup package comprises, besides the lidded cup, a lid 6 consisting principally of a discoid centre 7 and a surrounding rim 8 enlarged conically downwardly and bearing against the collar 5. The centre 7 is located in a shallow recess 14 in the lid 6, the recess receiving the bottom of the package placed on top as the packages are piled. The lid 6 is manufactured by bonding the centre 7 and the rim 8 with a technique known per se, which is used in sealing together the skirt and the bottom of drinking cups made of board. The cup collar 5 and the lid rim 8 are bonded together with a heat seal 9 surrounding the cup and forming the coating polymer of the board. For opening the package, a tear strip 11 defined by two aligned perforation lines 10 are formed along the rim 8 of the lid, with a protruding flap 12 at the end of the strip.

The cup package illustrated in FIG. 2 differs from the one of FIG. 1 mainly with respect to the design of the lid 6. The lid 6 has been designed to match the top of the cup skirt 3 and the collar 5 so as to comprise a conical rim 8 fitted tightly against the collar and a conical part 13 nested with the skirt, this part terminating in the centre 7 located in the recess 14 formed in the lid. The skirt 3 and said conical part 13 are dimensioned so that their mutual compression or friction retains the lid 6 in position at the mouth of the cup 1 even after the tear strip 11 has been removed. However, the lid 6 can be removed from the cup 1 by pulling and pressed back in the mouth of the cup for closing the cup after the product 2 has been consumed. Such a reclosable package is particularly suitable for snack products and sweets, which are not necessarily totally consumed at once. In the same manner as in FIG. 1, the recess 14 in the lid can receive the bottom of the package placed on top when the packages are piled.

FIGS. 3 and 4 show in greater detail the layered structure of the polymer-coated packaging board used for the package of the invention, the heat seal joining the package parts and the operation of the tear strip opening the package. The cup and its collar and the lid and its centre and rim included in the package have been formed of cup board 15, which has been extrusion coated with an inner oxygen and flavour barrier layer 16, which is made e.g. of ethyl vinyl alcohol copolymer (EVOH) or polyamide (PA), and with an outer heat-sealing layer 17, which is made e.g. of low-density polyethene (LDPE). At the cup collar 5 and the lid rim 8, the polymer coatings of the board bear against each other as illustrated in FIG. 3, and in the heat seal 9, the opposite heat-seal layers 17 are sealed together so as to form an annular, tight sealing line surrounding the package.

FIG. 3 shows that the tear strip 11 defined by perforations 10 has been formed inside the heat-sealing line 9 at the lid rim 8. The perforations 10 penetrate through the board layer 15 of the rim 8, however, without extending to the coating layers 16, 17 of the board. The protruding flap 12 forming the end of the tear stripe 11 may be located at the lateral seam (not shown) of the rim and it can be achieved with an appropriate design of the blank used for the rim. The package is opened by pulling the tear stripe 11 by the flap 12, so that the tear stripe and consequently the lid are removed, except for the stripe 18 outside the tear strip of the lid rim, at which the lid has been sealed to the cup collar 5 an which remains in position when the lid is opened, as illustrated in FIG. 4.

In the embodiment of the invention illustrated in FIG. 5, the tear strip 19 consists of a separate band, which is made e.g. of metal or tough plastic and is embedded between the material layers forming the cup collar 5 and the lid rim 8. To facilitate removal, the board layer 15 of the rim 8 is equipped with perforation lines 10 on both sides of the band 19. When the package is opened, the tear strip 19 ruptures the stripe 11 defined by perforations 10 so that it comes off the lid rim 8 and detaches the lid except for its outmost stripe 18, as explained above. The opening operation results in the outcome illustrated in FIG. 4.

FIGS. 6 and 7 show the embodiment of the heat-sealing between the cup and the lid and the tear stripe, which is based on a seal that is released when the strip is removed, i.e. on a peelable seal. The board 15 forming the lid has been coated with a barrier layer 16, which may be similar to the one described above, and with a heat-seal layer 17, for which a polymer material of peelable seal type has been selected. The board 15 used for the cup, in turn, has been coated with a polymer barrier layer 20, which acts as a sealing counter-surface in the collar 5. The barrier layer 20 may be made e.g. of polyethene terephtalate (PET) and the heat-seal layer 17 of the lid can be made e.g. of the polymer composition described in WO 03/033258, which contains a mixture of ethylene methyl acrylate copolymer (EMA), ethyl vinyl acetate copolymer (EVA) and polyamide wax, and which can be peelingly sealed to the PET layer. However, the coatings 17, 20 of the cup and the lid may also consist of other polymer materials peelingly sealed together in a similar manner. The tear strip 11 is defined by the perforation line 10 and is located at the lid rim so that the heat seal 9 is located in its totality in the area of the tear strip. The package is opened by gripping the flap 12 and pulling the tear strip 11, which comes off by being peeled along the seal line 9 from the material of the collar 5. As the tear strip 11 is detached, the lid is totally removed from the cup, in other words, as can be seen in FIG. 7, there will be no parts of the lid remaining at the cup collar 5.

It is obvious to those skilled in the art that the embodiments of the invention are not restricted to the examples above, but may vary within the scope of the following claims.

The invention claimed is:

1. A cup package made of a fibre-based material, comprising:

a cup (1) containing a packaged product (2); and a lid (6) closing a mouth of the cup, wherein the cup and the lid are made from polymer-coated board, the cup (1) comprises a mantle (3) bent sharply downward at the mouth (4) of the cup to form a collar (5) diverging from the mantle, the lid (6) has a downwardly oriented rim (8), at which the lid is fixed to the collar by heat sealing, the mantle (3) of the cup (1) is enlarged conically upwardly, the cup collar (5) is enlarged conically downwardly, and the lid rim (8) is enlarged conically downwardly.

2. The cup package as defined in claim 1, wherein an inner surface of the cup mantle (3) and an outer surface of the collar (5) are polymer coated.

3. The cup package as defined in claim 1, wherein an inner surface of the lid is polymer-coated.

4. The cup package as defined in claim 2, wherein the polymer coated board (15) includes an inner oxygen barrier layer (16) and an outer heat-sealing layer (17).

5. The cup package as defined in claim 1, wherein the lid (6) comprises, at its centre, a recess (14) defined by a conical surface (13) which is nested with the cup (1) so that the friction and/or compression between the cup mantle (3) and the opposite conical surfaces of the lid recess retain the lid in position in a reclosed package.

6. The cup package as defined in claim 1, wherein a recess (14) is formed at the centre of the lid (6) for receiving a bottom of another cup package.

7. The cup package as defined in claim 1, wherein an annular tear strip (11, 19) surrounding the lid is provided in the area of the rim (8) of the lid (6) for opening the package.

8. The cup package as defined in claim 7, wherein the tear strip is an annular stripe (11) defined by two aligned lines of perforations, the stripe being detached when torn.

9. The cup package as defined in claim 7, wherein the tear strip is an annular stripe (11') defined between a perforation line (10) and the lid rim, the lid (6) being peelably sealed in the collar (5) of the cup in the area of the stripe and detachable when torn.

10. The cup package as defined in claim 8 or 9, wherein the perforations in the line (10) penetrate through the board layer (15) of the lid (6), while leaving the subjacent polymer coating (16, 17) intact.

11. The cup package as defined in claim 1, wherein the package contains a foodstuff, such as a drink, a dessert or sweets.

12. The cup package as defined in claim 7, wherein the tear strip (19) consists of a separate band embedded between the material layers forming the cup collar (5) and the lid rim (8).

* * * * *